US006104176A

United States Patent [19]

McPartland et al.

[11] Patent Number: 6,104,176

[45] Date of Patent: Aug. 15, 2000

[54] VOLTAGE REGULATOR AND METHOD OF VOLTAGE REGULATION

[75] Inventors: Richard Joseph McPartland, Nazareth; Amit Kumar Banerjee, Emmaus, both of Pa.

[73] Assignee: Lucent Technologies, Inc., Murray Hill, N.J.

[21] Appl. No.: 09/069,733

[22] Filed: Apr. 30, 1998

[51] Int. Cl.[7] ..... G05F 3/02

[52] U.S. Cl. ..... 323/269; 323/313

[58] Field of Search ..... 323/313, 315, 323/317, 349, 350, 269, 299, 303, 280

[56] References Cited

U.S. PATENT DOCUMENTS 4,574,232 3/1986 Petty ..... 323/280 X
5,304,918 4/1994 Khieu ..... 323/315

*Primary Examiner*—Jessica Han

[57] ABSTRACT

The voltage regulator includes a regulator circuit, connected between a high potential and a low potential, regulating an output voltage based on an input voltage. The regulator circuit includes a changing circuit which changes at least one of a voltage range of the output voltage and a rate at which the output voltage changes with respect to changes in the input voltage. The changing circuit selectively increases a maximum value of the voltage range of the output voltage, and also selectively increases the rate at which the output voltage changes with respect to changes in the input voltage.

30 Claims, 3 Drawing Sheets

VOLTAGE REGULATOR AND METHOD OF VOLTAGE REGULATION

BACKGROUND OF THE INVENTION

1. Field of the Invention

The present invention relates to a voltage regulator and a method of voltage regulation.

2. Description of Prior Art

FIG. 1 illustrates a prior art voltage regulator 8 used on, for example, FLASH memory designs to generate regulated voltages below three volts for a variable load 24 from a five volt power supply. As shown in FIG. 1, the voltage regulator 8 includes a first N-MOS transistor 10 with a drain connected via a first resister 12 to a high potential voltage source VDD. The source of the first N-MOS transistor 10 is connected by a second resister 14 to a low potential voltage source VSS. The gate of the first N-MOS transistor 10 receives an input voltage, and the substrate of the first N-MOS transistor 10 is biased at the low potential VSS.

The source of a P-MOS transistor 20, included in the voltage regulator 8, is also connected to the high potential voltage source VDD, and the drain of the P-MOS transistor 20 is connected to the source of the first N-MOS transistor 10. As shown in FIG. 1, the drain of the P-MOS transistor 20 serves as the output for the voltage regulator 8. A gate of the P-MOS transistor 20 is connected to the drain of the first N-MOS transistor 10, and the substrate of the P-MOS transistor 20 is biased at the high potential VDD.

FIG. 1 illustrates one possible example of a variable load 24. As shown, the variable load 24 includes a capacitor 16 connected between the output of the voltage regulator 8 and ground. A switch 18 is connected in series with a third resistor 22 between the output of the voltage regulator 8 and ground as well.

During operation, as the switch 18 opens and closes, the load on the output of the voltage regulator 8 changes. However, the voltage regulator 8 compensates for these changes in load, and maintains a substantially constant voltage at the output. As the discussion below will reveal, the voltage maintained at the output depends on the voltage supplied to the input of the voltage regulator 8.

When the load on output of the voltage regulator 8 increases, the voltage at the output of the voltage regulator 8 drops. When the voltage at the output becomes less than the input voltage minus the threshold of the first N-MOS transistor 10, the first N-MOS transistor 10 turns on. As a result, current flows through the first N-MOS transistor 10 and the voltage at the gate of the P-MOS transistor 20 drops sufficiently to turn on the P-MOS transistor 20. With the P-MOS transistor 20 on, the output voltage is pulled high. Specifically, the output voltage reaches the input voltage minus the threshold of the first N-MOS transistor 10. Accordingly, the voltage regulator 8 operates based on the feedback output voltage.

Because the source of the first N-MOS transistor 10 is above the low potential VSS, the threshold of the first N-MOS transistor 10 increases due to the back-gate bias effect, and can be as high as a few volts. In other words, as the output voltage increases so does the threshold of the first N-MOS transistor 10. Therefore, the output voltage can only attain a maximum voltage of about three volts when the high potential VDD is five volts.

FIG. 5 illustrates the output voltage with respect to the input voltage for both the voltage regulator embodiments of the present invention and the conventional art of FIG. 1 assuming the low potential VSS is 0 volts and the high potential VDD is at least 5 volts. Specifically, a first curve 100 in FIG. 5 illustrates the output voltage with respect to the input voltage for the voltage regulator 8 of FIG. 1. As shown, the voltage regulator 8 generates a regulated output voltage ranging from 0 volts to just over 3 volts. When the input voltage is less than the low potential VSS plus the threshold of the first N-MOS transistor 10 (e.g., below about 0.5V as shown in FIG. 5), the output voltage is no longer regulated and floats at about the low potential VSS.

SUMMARY OF THE INVENTION

The voltage regulator according to the present invention includes circuitry for changing a relationship between the voltage input to the voltage regulator and the voltage output therefrom. In a typical embodiment, by inserting one or more active elements, for example transistors, between the source of a first N-MOS transistor and the drain of a P-MOS transistor (i.e., the output voltage feedback path) in the voltage regulator, the maximum value of the output voltage is increased to at least a maximum value of the input voltage. Namely, the rate at which the output voltage changes with respect to changes in the input voltage is selectively increased to one or more higher rates.

BRIEF DESCRIPTION OF THE DRAWINGS

The present invention will become more fully understood from the detailed description given hereinbelow and the accompanying drawings which are given by way of illustration only, wherein like reference numerals designate corresponding parts in the various drawings, and wherein.

DETAILED DESCRIPTION OF THE PREFERRED EMBODIMENTS

Figure 1:
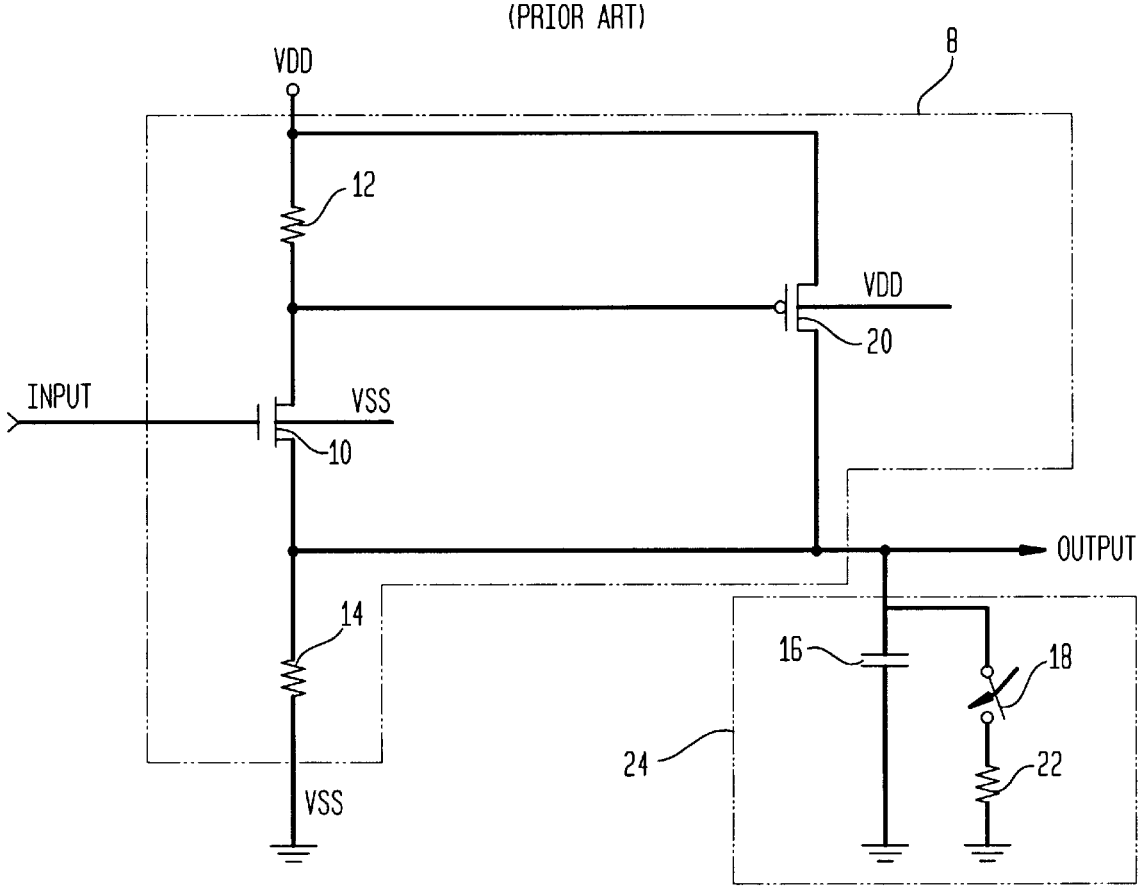
FIG. 1 (PRIOR ART)
FIG. 1 illustrates a conventional voltage regulator.
Figure 2:
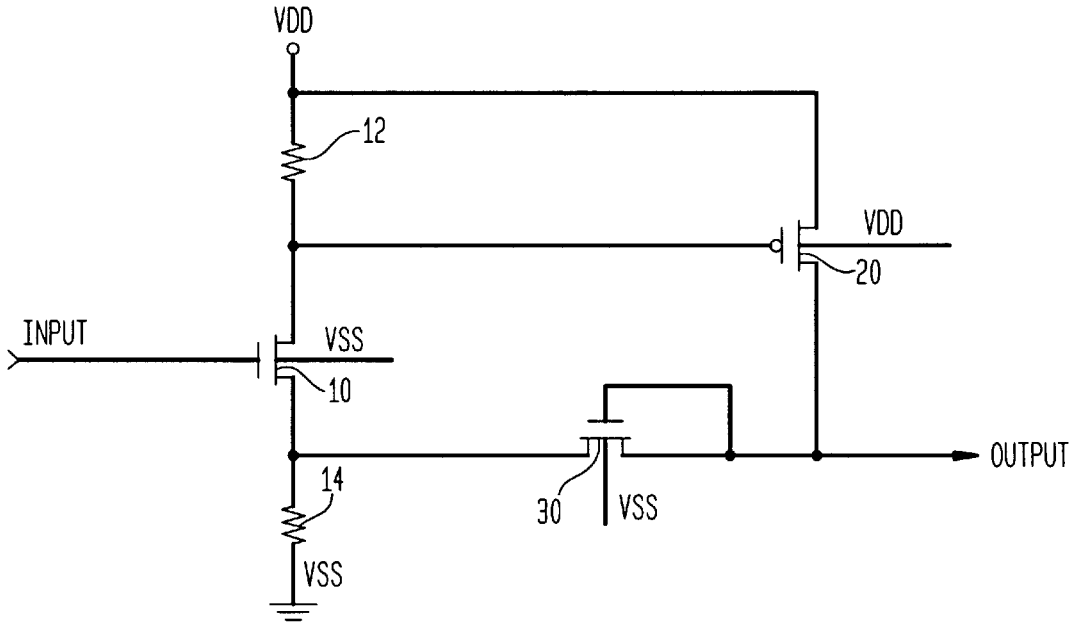
FIG. 2 illustrates one embodiment of a voltage regulator according to the present invention.

The following detailed description relates to a voltage regulator and method of voltage regulation. FIG. 2 illustrates one embodiment of the voltage regulator according to the present invention. As shown, the voltage regulator according to the present invention includes the same circuitry as discussed above with respect to the voltage regulator 8 of FIG. 1. Accordingly, this circuitry will not be discussed in detail; instead, only the differences between the voltage regulator of FIG. 2 and the voltage regulator 8 of FIG. 1 will be described.

As shown in FIG. 2, in this first embodiment, a second N-MOS transistor 30 is connected between the drain of the P-MOS transistor 20 and the source of the first N-MOS transistor 10. Specifically, the drain of the second N-MOS transistor 30 is connected to the drain of the P-MOS transistor 20, and the source of the second N-MOS transistor 30 is connected to the source of the first N-MOS transistor 10. The gate of the second N-MOS transistor 30 is also connected to the drain of the P-MOS transistor 20, and the substrate of the second N-MOS transistor is biased at the low potential VSS.

The second N-MOS transistor 30 lowers the output voltage feedback to the source of the first N-MOS transistor 10 by the threshold of second N-MOS transistor 30. Because the sources of the first N-MOS transistor 10 and the second N-MOS transistor 30 are at the same potential, both the first and second N-MOS transistors 10 and 30 see the same back-gate voltage; and therefore, have the same thresholds. Accordingly, the second N-MOS transistor 30 cancels the reduction of the maximum value of the output voltage caused by the increased threshold of the first N-MOS transistor 10 due to the back-gate bias effect.

Namely, when the output voltage falls below the input voltage, the source of the first N-MOS transistor 10 falls below a value equal to the input voltage minus the threshold of the first N-MOS transistor 10 because of the second N-MOS transistor 20. Therefore, the first N-MOS transistor 10 turns on, the P-MOS transistor 20 turns on, and the output voltage increases until equal to the input voltage. At this point, the source of the first N-MOS transistor 10 is elevated to a value equal to the input voltage minus the threshold voltage of the first N-MOS transistor 10, and the first N-MOS transistor 10 turns off. This in turn turns off the P-MOS transistor 20.

Figure 5:
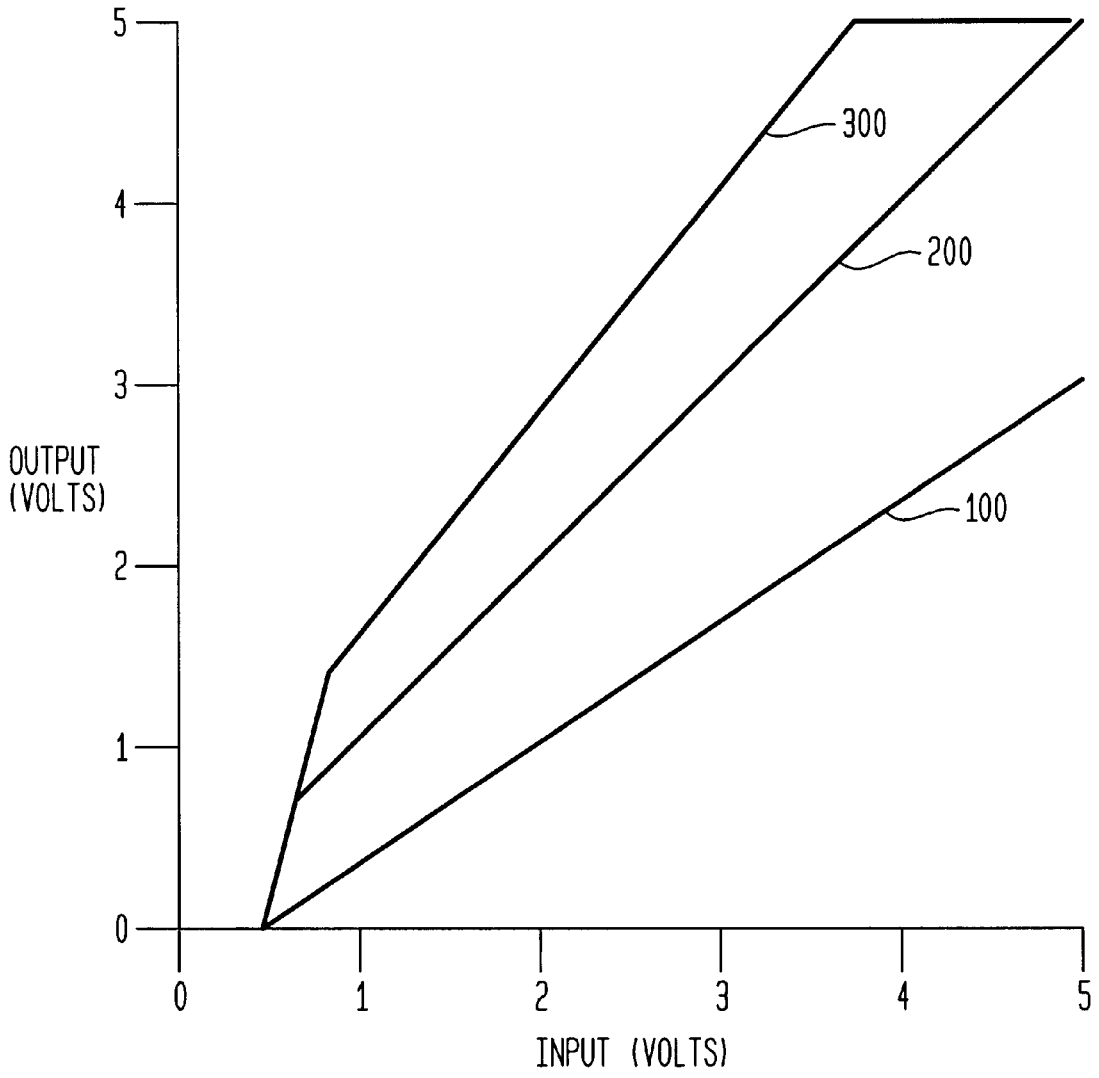
FIG. 5 illustrates the output voltage with respect to the input voltage for both the voltage regulator embodiments of the present invention and the conventional art of FIG. 1.

However, instead of the low potential VSS, the lowest regulated voltage which can appear at the output of the voltage regulator in FIG. 2 is the low potential VSS plus the threshold of the second N-MOS transistor 30. The second curve 200 in FIG. 5 illustrates the output voltage with respect to the input voltage for the voltage regulator of FIG. 2 assuming the low potential VSS is 0 volts and the high potential VDD is at least 5 volts. As shown, the regulated output voltage ranges from a minimum voltage of the low potential VSS plus the threshold of the second N-MOS transistor 30 to the high potential VDD. Furthermore, a comparison of the second curve 200 to the first curve 100 shows that in the voltage regulator of FIG. 2, the rate at which the output voltage changes with respect to changes in the input voltage is increased.

Figure 3:
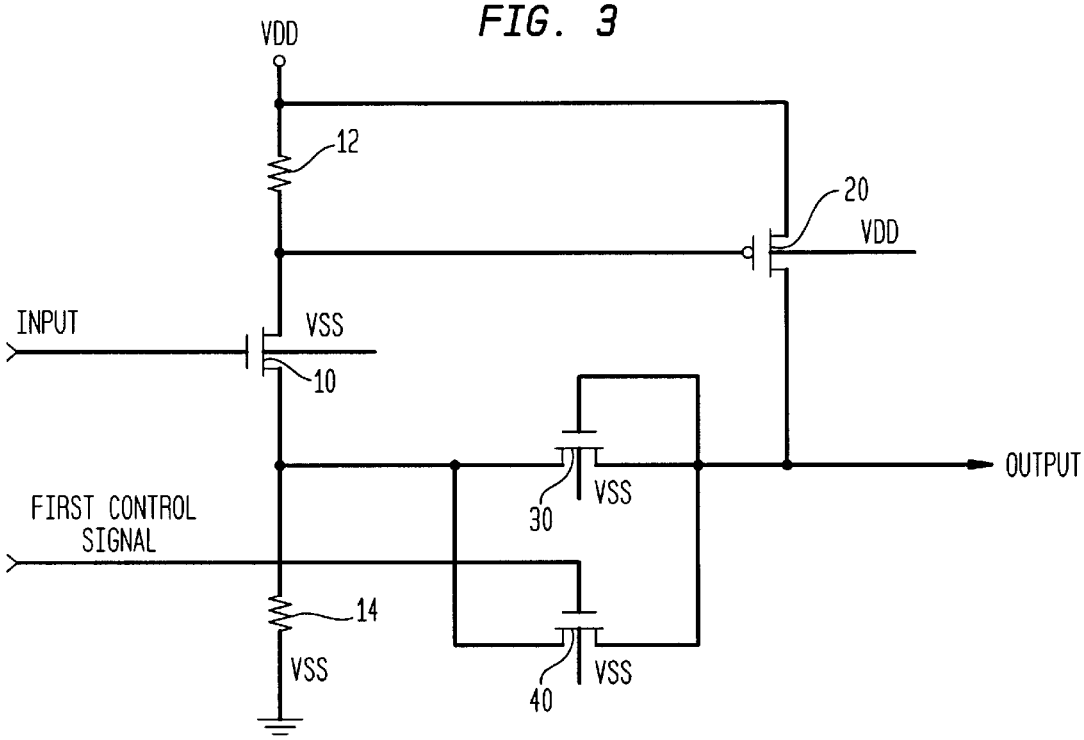
FIG. 3 illustrates another embodiment of a voltage regulator according to the present invention.

FIG. 3 illustrates another embodiment of the voltage regulator according to the present invention. FIG. 3 includes the same circuitry as discussed above with respect to FIG. 2 and further includes a third N-MOS transistor 40. Accordingly, only the differences between FIG. 2 and FIG. 3 will be described.

The drain of the third N-MOS transistor 40 is connected to the drain of the P-MOS transistor 20, and the source of the third N-MOS transistor 40 is connected to the source of the second N-MOS transistor 30. The gate of the third N-MOS transistor 40 receives a first control signal, and the substrate of the third N-MOS transistor 40 is biased at the low potential VSS.

The embodiment of the voltage regulator shown in FIG. 3 operates the same as the voltage regulator shown in FIG. 2 when the third N-MOS transistor 40 is off. When the third N-MOS transistor 40 is on, the third N-MOS transistor 40 shorts the second N-MOS transistor 30 and the voltage regulator operates the same as the voltage regulator 8 in FIG. 1.

Accordingly, the voltage regulator of FIG. 3 is capable of switching between two different modes of operation; and therefore, can selectively supply output voltages as shown by the first and second curves 100 and 200 in FIG. 5.

The digital input data (or the complement thereof) supplied to a, for example, digital-to-analog converter, of which the voltage regulator forms a part, can be used as the first control signal. One skilled the art, however, will appreciate that any appropriate control signal may be applied to the gate of the third N-MOS transistor 40.

Figure 4:
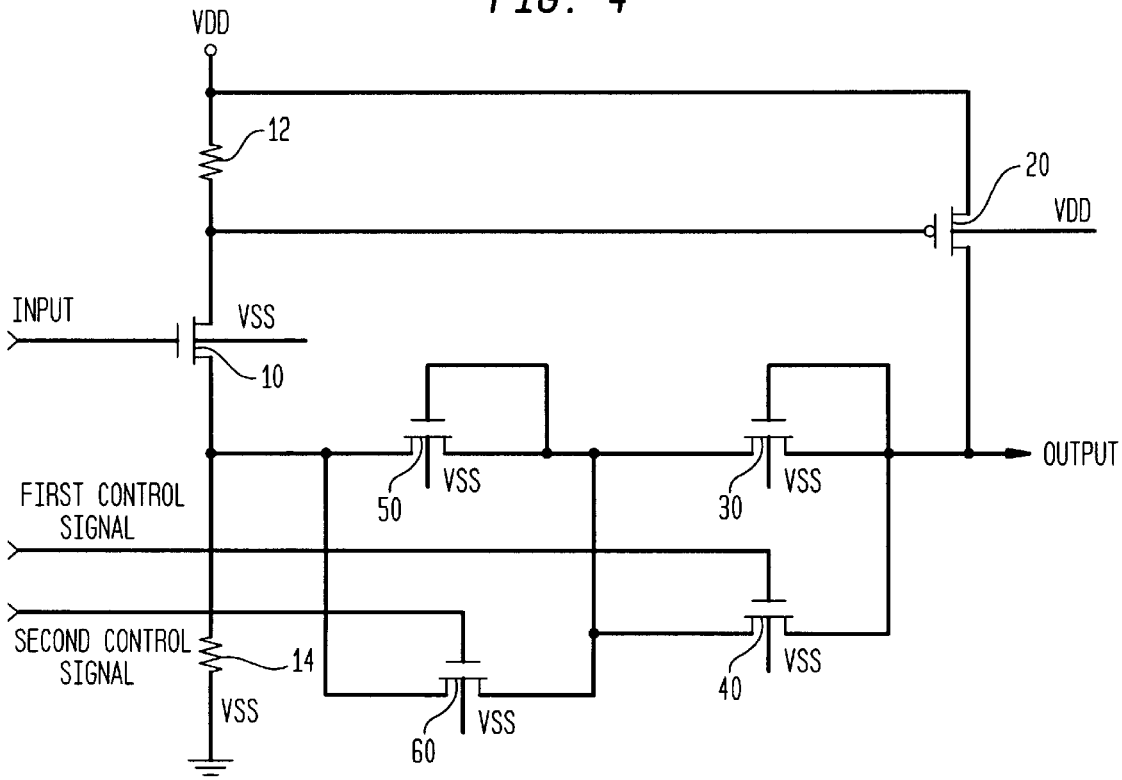
FIG. 4 illustrates a further embodiment of the voltage regulator according to the present invention.

FIG. 4 illustrates a further embodiment of the voltage regulator according to the present invention. FIG. 4 includes the same circuitry as the voltage regulator shown in FIG. 3, and further includes a fourth N-MOS transistor 50 and a fifth N-MOS transistor 60. Accordingly, only the differences between the voltage regulator of FIG. 4 and the voltage regulator of FIG. 3 will be described.

The gate and drain of the fourth N-MOS transistor 50 are connected to the source of the second N-MOS transistor 30. The source of the fourth N-MOS transistor 50 is connected to the source of the first N-MOS transistor 10, and the substrate of the fourth N-MOS transistor 50 is biased at the low potential VSS. The drain of the fifth N-MOS transistor 60 is connected to the source of the third N-MOS transistor 40, and the source of the fifth N-MOS transistor 60 is connected to the sources of the first and fourth N-MOS transistors 10 and 50. The gate of the fifth N-MOS transistor 60 receives a second control signal, and the substrate of the fifth N-MOS transistor 60 is biased at the low potential VSS.

The addition of the fourth N-MOS transistor 50, between the sources of the first N-MOS transistor 10 and the second N-MOS transistor 30, lowers the voltage at the source of the first N-MOS transistor 10 by the threshold of another N-MOS transistor. As a result, the first N-MOS transistor 10 and the P-MOS transistor 20 will remain on until the output voltage reaches the input voltage plus the threshold of the second N-MOS transistor 30.

As discussed above, when on, the third N-MOS transistor 40 serves to short the second N-MOS transistor 30. Similarly, the fifth N-MOS transistor 60, when on, serves to short the fourth N-MOS transistor 50. When the gates of the third and fifth N-MOS transistors 40 and 60 are supplied with first and second control signals which turn those transistors on, the second and fourth N-MOS transistors 30 and 40 are shorted.

Instead of the low potential VSS or the low potential VSS plus the threshold of the second N-MOS transistor 30, the lowest regulated voltage which can appear at the output of the voltage regulator in FIG. 4 when both the third and fifth N-MOS transistors 40 and 60 are off is the low potential VSS plus the thresholds of both the second and fourth N-MOS transistors 30 and 50. The third curve 300 in FIG. 5 illustrates the output voltage with respect to the input voltage for the voltage regulator of FIG. 4 assuming the low potential VSS is 0 volts, the high potential VDD is at least 5 volts, and the third and fifth N-MOS transistors 40 and 60 are off. When only one of the third and fifth N-MOS transistors 40 and 60 is on, the voltage regulator of FIG. 4 operates in the same manner as the voltage regulator shown in FIG. 2 and the second curve 200 in FIG. 5 represents the output voltage range. When both the third and fifth N-MOS transistors 40 and 60 are on, the voltage regulator of FIG. 4 operates in the same manner as the voltage regulator 8 shown in FIG. 1 and the first curve 100 in FIG. 5 represents the output voltage range. As a comparison of the third curve 300 to the first and second curves 100 and 200 shows, the rate at which the output voltage changes with respect to changes in the input voltage is increased further still due to the back-gate bias effect upon the thresholds of the second and fourth N-MOS transistors 30 and 50. Accordingly, selectively turning on and off the third and fifth N-MOS transistors 40 and 60 also selectively sets the rate at which the output voltage changes.

The first and second control signals can be selectively and independently applied to control the operating mode of the voltage regulator shown in FIG. 4. Alternatively, the same signal can be supplied as both the first and second control signals.

In addition, because, for a given output voltage, the P-MOS transistor 20 in the embodiment of FIG. 4 is turned on harder than in the embodiment of FIG. 2, a physically smaller P-MOS transistor can be used as the P-MOS transistor 20 and/or a higher performance voltage regulator (e.g., a voltage regulator which responds faster to raising the input voltage) can be obtained.

It should be understood that any active element, such as a diode, could be used in place of the second and/or fourth N-MOS transistors 30 and 50 in the above-described embodiments, and that any switching element could be used in place of the third and fourth N-MOS transistors 40 and 60 in the abovedescribed embodiments.

The invention being thus described, it will be obvious that the same may be varied in many ways. Such variations are not to be regarded as a departure from the spirit and scope of the invention, and all such modifications are intended to be included within the scope of the following claims.

We claim:

1. An integrated circuit including a voltage regulator, comprising:

a regulator circuit, connected between a high potential and a low potential, regulating an output voltage to a substantially constant value with respect to changes in load thereon, said regulator circuit including a feedback path feeding back said output voltage, and said regulator circuit setting said constant value based on an input voltage and said feedback output voltage, said regulator circuit including, a changing circuit changing said feedback output voltage to change at least one of (1) a voltage range of said constant value as compared with an absence of said changing circuit and (2) a rate at which said constant value changes with respect to changes in said input voltage as compared with an absence of said changing circuit.

2. The integrated circuit of claim 1, wherein said changing circuit changes said feedback output voltage to increase a maximum value of said voltage range of said constant value as compared with an absence of said changing circuit.

3. The integrated circuit of claim 1, wherein said changing circuit changes said feedback output voltage to increase a maximum value of said voltage range of said constant value and maintains a minimum value of said voltage range as compared with an absence of said changing circuit.

4. The integrated circuit of claim 1, wherein said changing circuit changes said feedback output voltage to increase said rate at which said constant value changes with respect to changes in said input voltage as compared with an absence of said changing circuit.

5. The integrated circuit of claim 1, wherein said changing circuit is disposed in said feedback path.

6. The integrated circuit of claim 5, wherein said changing circuit decreases said feedback output voltage.

7. The integrated circuit of claim 5, wherein said changing circuit selectively decreases said feedback output voltage.

8. The integrated circuit of claim 5, wherein said changing circuit selectively places said regulator circuit in one of at least two operating modes by changing said feedback output voltage, each operating mode having a different rate at which said constant value changes with respect to changes in said input voltage.

9. The integrated circuit of claim 1, wherein said changing circuit selectively changes said feedback output voltage to selectively change said rate at which said constant value changes with respect to said input voltage as compared with an absence of said changing circuit.

10. The integrated circuit of claim 1, wherein said changing circuit selectively changes said feedback output voltage to selectively change said voltage range of said constant value as compared with an absence of said changing circuit.

11. The integrated circuit of claim 1, wherein said changing circuit includes at least one active element.

12. The integrated circuit of claim 11, wherein said active element is a transistor.

13. The integrated circuit of claim 1, wherein said regulator circuit comprises:

a first transistor having a first terminal, a second terminal and a first gate, said first terminal connected to said high potential, said second terminal connected to said low potential, and said first gate receiving said input voltage; and a second transistor having a third terminal, a fourth terminal and a second gate, said third terminal connected to said high potential, said fourth terminal serving as an output, and said second gate connected to said first terminal. transistor.

14. The integrated circuit of claim 13, wherein said regulator circuit further comprises:

a first resistor disposed between said high potential and said first terminal; and a second resistor disposed between said low potential and said second terminal.

15. The integrated circuit of claim 13, wherein said first transistor is an N-MOS transistor; and said second transistor is a P-MOS transistor.

16. The integrated circuit of claim 13, wherein said changing circuit further comprises:

a third transistor having a fifth terminal, a sixth terminal and a third gate, said fifth terminal connected to said fourth terminal, said sixth terminal connected to said second terminal, and said third gate connected to said fourth terminal.

17. The integrated circuit of claim 16, wherein said third transistor is an N-MOS transistor.

18. The integrated circuit of claim 16, wherein said changing circuit further comprises:

a fourth transistor having a seventh terminal, an eighth terminal and a fourth gate, said seventh terminal connected to said fourth terminal, said eighth terminal connected to said second terminal, and said fourth gate receiving a control signal.

19. The integrated circuit of claim 16, wherein said third and fourth transistors are N-MOS transistors.

20. The integrated circuit of claim 16, wherein said changing circuit further comprises:

a third transistor having a fifth terminal, a sixth terminal and a third gate, said fifth terminal connected to said fourth terminal, and said third gate connected to said fourth terminal;

a fourth transistor having a seventh terminal, an eighth terminal and a fourth gate, said seventh terminal connected to said fourth terminal, said eighth terminal connected to said sixth terminal, and said fourth gate receiving a first control signal;

a fifth transistor having a ninth terminal, a tenth terminal and a fifth gate, said ninth terminal connected to said sixth terminal, said tenth terminal connected to said second terminal, and said fifth gate connected to said sixth terminal; and a sixth transistor having an eleventh terminal, a twelfth terminal, and a sixth gate, said eleventh terminal connected to said sixth terminal, said twelfth terminal connected to said second terminal, and said sixth gate receiving a second control signal.

21. The integrated circuit of claim 20, wherein said third, fourth, fifth and sixth transistors are N-MOS transistors.

22. A method of regulating a voltage, comprising:

receiving an input voltage;

regulating an output voltage to a substantially constant value with respect to changes in a load receiving said output voltage;

feeding back said regulated output voltage to obtain a feedback output voltage;

setting said constant value based on said input voltage and said feedback output voltage; and changing said feedback output voltage to change at least one of (1) a voltage range of said constant value as compared with an absence of said changing step and (2) a rate at which said constant value changes with respect to changes in said input voltage as compared with an absence of said changing step.

23. The method of claim 22, wherein said changing step changes said feedback output voltage to increase a maximum value of said voltage range of said constant value as compared with an absence of said changing step.

24. The method of claim 22, wherein said changing step changes said feedback output voltage to increase a maximum value of said voltage range of said constant value and maintains a minimum value of said voltage range as compared with an absence of said changing step.

25. The method of claim 22, wherein said changing step changes said feedback output voltage to increase said rate at which said constant value changes with respect to changes in said input voltage as compared with an absence of said changing step.

26. The method of claim 22, wherein said changing step selectively changes said feedback output voltage to selectively change said rate at which said constant value changes with respect to changes in said input voltage as compared with an absence of said changing step.

27. The method of claim 22, wherein said changing step decreases said feedback output voltage.

28. The method of claim 22, wherein said changing step selectively decreases said feedback output voltage.

29. The method of claim 22, wherein said changing step selectively changes said feedback output voltage to selectively change said rate at which said constant value changes with respect to changes in said input voltage as compared with an absence of said changing step.

30. The method of claim 22, wherein said changing step selectively changes said feedback output voltage to selectively change said voltage range of said constant value as compared with an absence of said changing step.

* * * * *